US007216499B2

(12) United States Patent
Flinner et al.

(10) Patent No.: US 7,216,499 B2
(45) Date of Patent: May 15, 2007

(54) REFRIGERATOR AND ICEMAKER FOR THE REFRIGERATOR

(75) Inventors: Klaus Flinner, Zöschingen (DE); Georg Hausmann, Dillingen (DE); Stefan Holzer, Aalen (DE); Jörg Stelzer, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/985,473

(22) Filed: Nov. 10, 2004

(65) Prior Publication Data

US 2005/0061009 A1 Mar. 24, 2005

Related U.S. Application Data

(63) Continuation of application No. PCT/EP03/05008, filed on May 13, 2003.

(30) Foreign Application Priority Data

May 16, 2002 (DE) ..... 102 21 897

(51) Int. Cl.
*F25C 1/04* (2006.01)

(52) U.S. Cl. ..... 62/233; 62/434; 62/340

(58) Field of Classification Search ..... 62/340–356, 62/430–439

See application file for complete search history.

(56) References Cited

U.S. PATENT DOCUMENTS

| | | | | | |
|---|---|---|---|---|---|
| 1,948,681 | A | | 2/1934 | Sawyer | |
| 2,301,313 | A | | 11/1942 | Money et al. | |
| 2,421,773 | A | | 6/1947 | Buchanan | |
| 2,435,102 | A | | 1/1948 | Rundell | |
| 2,503,922 | A | | 4/1950 | Schumacher | |
| 3,788,089 | A | | 1/1974 | Graves | |
| 3,866,429 | A | | 2/1975 | Blomberg | |
| 4,003,214 | A | * | 1/1977 | Schumacher | 62/340 |
| 4,271,681 | A | * | 6/1981 | Schertz | 62/260 |
| 4,355,522 | A | * | 10/1982 | Gorski et al. | 62/340 |
| 4,756,164 | A | * | 7/1988 | James et al. | 62/119 |
| 6,092,374 | A | | 7/2000 | Kang et al. | |

FOREIGN PATENT DOCUMENTS

DE 34 45 968 C1 3/1986

* cited by examiner

*Primary Examiner*—William E. Tapolcai
(74) *Attorney, Agent, or Firm*—Russell W. Warnock; Craig J. Loest

(57) ABSTRACT

An icemaker for a refrigeration device contains a refrigerant circuit and an ice container that is located in a subassembly housed in a refrigeration compartment of the refrigeration device. The ice container is in thermal contact with the refrigerant circuit by a first heat exchanger. A second subassembly that is located in a freezer compartment of the refrigeration device contains a second heat exchanger of the refrigerant circuit. Water in the ice container is cooled by the dissipation of heat from the second heat exchanger to the freezer compartment.

17 Claims, 2 Drawing Sheets

REFRIGERATOR AND ICEMAKER FOR THE REFRIGERATOR

CROSS-REFERENCE TO RELATED APPLICATION

This is a continuing application, under 35 U.S.C. § 120, of copending international application No. PCT/EP03/05008, filed May 13, 2003, which designated the United States; this application also claims the priority, under 35 U.S.C. § 119, of German patent application No. 102 21 897.8, filed May 16, 2002; the prior applications are herewith incorporated by reference in their entirety.

BACKGROUND OF THE INVENTION

Field of the Invention

The present invention relates to an icemaker for use in a refrigerator, and to a refrigerator equipped with such an icemaker.

The simplest form of an icemaker for a refrigerator is a water fillable tray that is subdivided into a plurality of chambers and can be positioned in the freezer compartment of a refrigerator in order for water located in it to be frozen.

The freezing operation takes up a large amount of time since cooling of the tray by contact with the evaporator of the freezer compartment is only possible at the base of the tray, if the evaporator itself forms the base of the freezer compartment. In the case of modern refrigerators, the evaporator is generally disposed on the rear wall of the freezer compartment, with the result that the tray is cooled essentially only indirectly via air circulating in the freezer compartment, this taking up an even greater amount of time. An unexpected requirement for ice cannot be met in a short period using this straightforward icemaker.

In order to speed up the ice-making operation, refrigerators in which an icemaker is connected to the refrigerant circuit of the refrigerator, and is supplied with refrigerant from the circuit, have been proposed. Although this solution is very efficient, it is technically complex and thus costly, with the result that it is more suitable for commercial use than for private use.

SUMMARY OF THE INVENTION

It is accordingly an object of the invention to provide a refrigerator and an icemaker for the refrigerator that overcomes the above-mentioned disadvantages of the prior art devices of this general type, which both allow ice to be made quickly and can nevertheless be realized cost-effectively.

With the foregoing and other objects in view there is provided, in accordance with the invention, an icemaker for a refrigerator. The icemaker contains an ice container and a refrigerant circuit containing a refrigerant and a first heat exchanger. The refrigerant circuit is in thermal contact with the ice container through the first heat exchanger. The refrigerant circuit is separate from a further refrigerant circuit of the refrigerator to which the icemaker can be fitted. The refrigerant circuit further has a second heat exchanger to be placed in a cooling zone of the refrigerator.

A significant feature of the icemaker according to the invention is the fact that its refrigerant circuit is separate from that of a refrigerator in which the icemaker can be used. In other words, the refrigerant circuit of the icemaker according to the invention is self-contained; it has its own refrigerant which is separate from that of the refrigerator.

This makes it considerably easier for the icemaker to be installed in a refrigerator since, at most, only small adaptations have to be made to a conventional refrigerator in order for it to be possible to install the icemaker, and there is no need for any through-passages between the refrigerant circuits of the refrigerator and icemaker.

The cooling of the icemaker, which is necessary for producing ice, can take place straightforwardly by heat exchange in a second heat exchanger, which can be placed in a cooling zone of the refrigerator which reaches temperatures below 0° C. It is thus possible for the refrigerant circulating in the refrigerant circuit of the icemaker to be cooled to the extent where it is capable of freezing water in the ice container, via the first heat exchanger, without the icemaker having to have a dedicated refrigerating machine. The icemaker according to the invention can thus be produced cost-effectively.

Since the refrigerant of the icemaker thus need not be operated in thermodynamic circulation, it may advantageously be selected such that it remains liquid throughout the refrigerant circuit under normal operating conditions of the icemaker. It is thus possible, with a comparatively low volume throughput of the refrigerant, to transport greater quantities of heat than with a gaseous refrigerant.

The second heat exchanger is preferably configured as a reservoir for the refrigerant, i.e. its volume is greater than would be necessary from the point of view of efficient heat exchange with through flow of the refrigerant. It is thus possible to store a large quantity of cold refrigerant in the second heat exchanger if the icemaker is not being used. When the icemaker is brought into operation, in contrast, a large quantity of cooled refrigerant is available straight away.

For the purpose of circulating the refrigerant, the icemaker is preferably provided with a pump. This may advantageously be assigned a timing device for controlling the operation of the pump. This makes it possible, once the icemaker has been set in operation by a user, for the pump to be switched off automatically following a period of time which is expected to be sufficient for freezing the water which has been introduced. It is thus ensured that that cooling zone of the refrigerator in which the second heat exchanger is accommodated is not fed heat on a constant basis, via this heat exchanger, if this is no longer necessary for the purpose of freezing the water in the ice container. Moreover, switching off the pump allows the surface of the finished ice in the ice container to start melting, which makes it easier for the ice to be removed from the ice container.

The refrigerator according to the invention has at least a first and a second cooling zone, which can be retained at different temperatures, and the ice container is disposed in the first cooling zone and the second heat exchanger is disposed in the second cooling zone. If the icemaker is in operation, then the ice container and the first heat exchanger, which is connected thereto, help to cool the first cooling zone, while the second cooling zone is heated by the second heat exchanger. While the operation of the icemaker causes the cooling-capacity requirement for the second cooling zone to increase, that of the first cooling zone decreases correspondingly, with the result that the overall cooling-capacity requirement of the refrigerator is not influenced to any significant extent by the operation of the icemaker.

Space-saving accommodation of the second heat exchanger is possible, in particular, at the top or at the bottom of the second cooling zone.

In order to achieve a large heat-exchanger surface area, the second heat exchanger preferably extends essentially over the entire width and/or depth of the second cooling zone.

The icemaker of the refrigerator can advantageously be installed and removed. It is thus possible, when the icemaker is not in use, for space that is otherwise taken up by the icemaker to be utilized for other items for cooling.

In order to facilitate the installation and removal, a plug-in connector for supplying power to the pump is preferably disposed on an inner wall of a cooling zone.

It is also expedient for the refrigerant circuit, between the first and the second heat exchangers, to be formed, at least in part, by flexible hoses. On the one hand, this makes it possible to position the ice container in the first cooling zone at different locations which are not occupied by items for cooling; on the other hand, the movement capability of the ice container in relation to the second heat exchanger, this being achieved by way of the hoses, makes it possible for the icemaker to be stored in a space-saving manner when it has been removed.

Other features which are considered as characteristic for the invention are set forth in the appended claims.

Although the invention is illustrated and described herein as embodied in a refrigerator and an icemaker for the refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
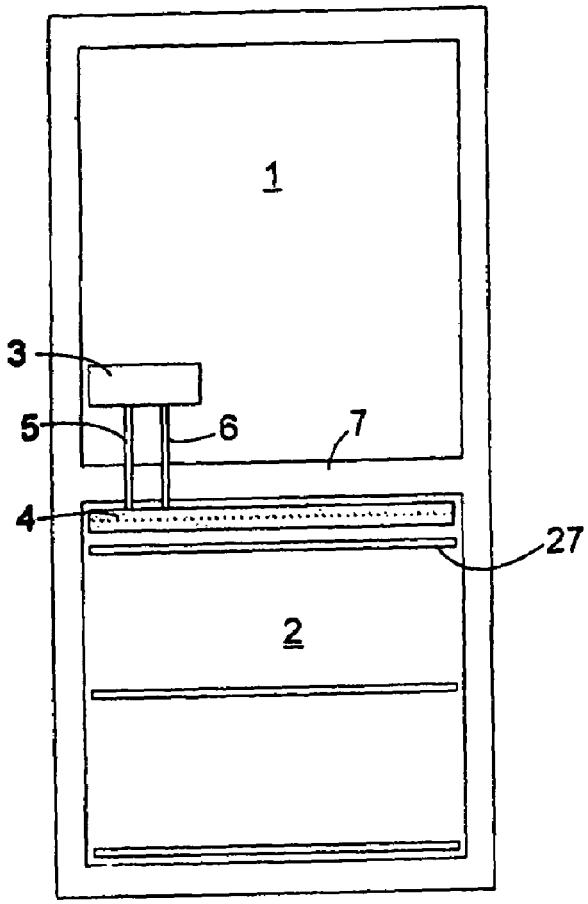
FIG. 1 is a diagrammatic, front-elevational view of a front of a refrigerator according to the invention having two compartments which are separated from one another by a partition wall and are at different temperatures, the refrigerator being illustrated without a door.

Referring now to the figures of the drawing in detail and first, particularly, to FIG. 1 thereof, there is shown a schematic front view of a refrigerator with an icemaker according to the present invention. The refrigerator has two cooling zones, a refrigerating compartment or chiller compartment 1 in a top region of the appliance, which, during normal operation of the refrigerator, is retained at temperatures above 0° C., and a freezer compartment 2 in the bottom region, which, during normal operation, is retained at temperatures below 0° C. The two compartments 1, 2 can be closed by a common door or preferably individually in each case by separate doors, which are not illustrated in the figure.

An icemaker installed in the refrigerator essentially contains two subassemblies 3, 4 which are disposed in the refrigerating compartment 1 and the freezer compartment 2, respectively. The first subassembly 3 contains a first heat exchanger and an ice container and is illustrated in detail in FIG. 2; the second subassembly contains a pump and a second heat exchanger and is illustrated in detail in FIG. 3. The two subassemblies are connected to one another by refrigerant lines 5, 6. In the case of a refrigerator which has a single door for the two compartments 1, 2 and in which the compartments are not necessarily separated off from one another in an air-tight manner, the refrigerant lines 5, 6 can extend freely over the front edge of a horizontal partition wall 7, by which the two compartments 1, 2 are separated off from one another. If each compartment 1 and 2 is equipped with its own door, it is possible, as is illustrated in FIG. 4, to form, on the front edge of the partition wall 7, a cutout 8 into which a closure body 9 can be inserted such that complementary semicylindrical indents 10 on the peripheries of the cutout 8 and of the closure body 9 together bound through-passages for the refrigerant lines 5, 6 and, at the same time, the front periphery 11 of the closure body 9 terminates flush with that of the partition wall 7.

Figure 2:
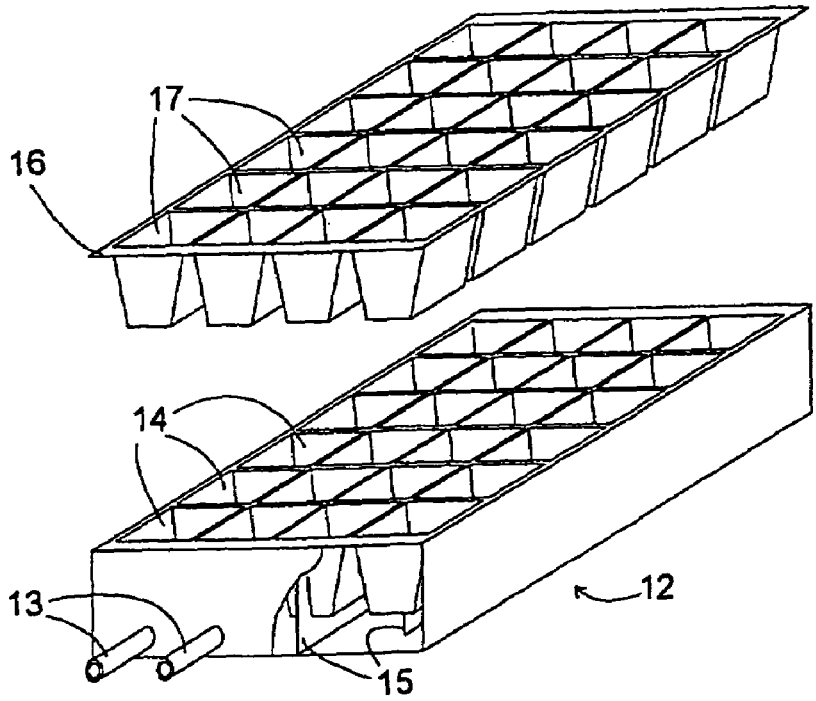
FIG. 2 is an exploded, perspective view of a first heat exchanger and of an ice container of the icemaker according to the invention.

FIG. 2 shows a possible configuration of the first subassembly 3 of the ice maker. The first heat exchanger 12 of the subassembly 3 here is configured as a hollow body made of metal or plastic with two connectors 13 for the refrigerant lines 5, 6 on a side wall of the heat exchanger 12 and a multiplicity of compartments or depressions 14 on a top side of the heat exchanger 12. The front side wall of the first heat exchanger 12 is illustrated in partly cut-away form, in order to show partition walls 15 which are disposed in the interior of the heat exchanger 12 and by which heat-transfer fluid flowing through the heat exchanger 12 is caused to follow a meandering path which passes over the bases and side walls of all the depressions 14.

In the case of a straightforward configuration, the ice container may be formed by all the depressions 14 alone. In the case of the configuration in question here, however, the ice container provided is a thin-walled tray 16 with a multiplicity of depressions 17 which are dimensioned in order to engage in a form-fitting manner in the depressions 14 of the first heat exchanger 12. It is thus possible for the ice container 16, once water has frozen in its depressions 17, to be removed without the first heat exchanger 12 having to be removed at the same time.

Figure 3:
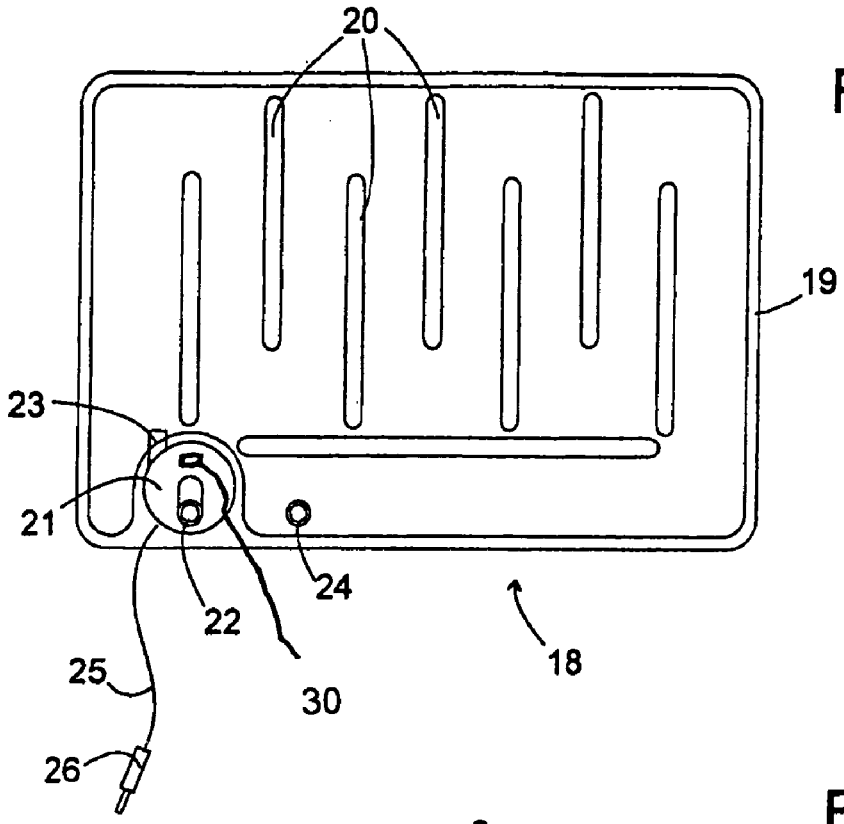
FIG. 3 is a plan view of a second heat exchanger of the ice maker.
Figure 4:
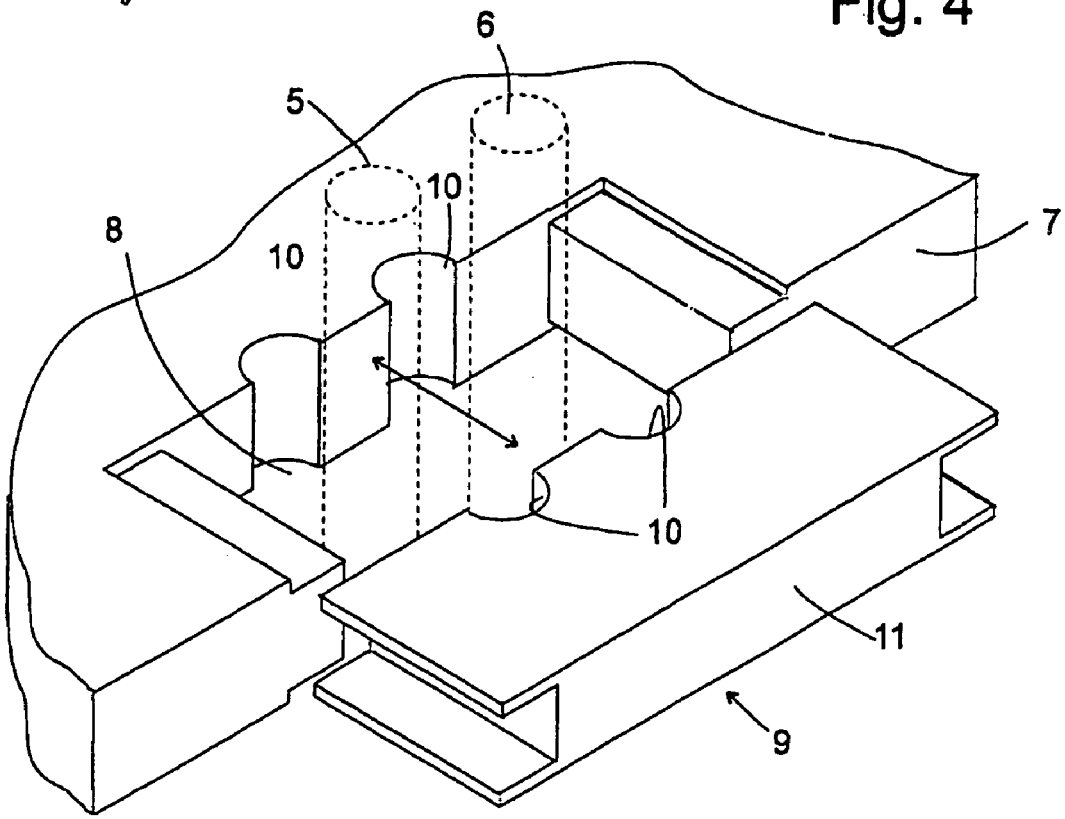
FIG. 4 is a partial, perspective view of the partition wall in its region which is in the vicinity of the door.

FIG. 3 shows a plan view of a possible configuration of the second heat exchanger 18 of the ice maker. This is constructed from two shallow plastic half-trays that are welded to one another along their peripheries and along a plurality of lines 20 in order to define a meandering flow path for the refrigerant.

The volume of the second heat exchanger 18 is of a similar order of magnitude as that of the ice container 16. It is thus possible, at least at the beginning of an ice-making operation, to cool the water in the ice container 16 at a considerably higher capacity than the capacity exchanged in the second heat exchanger 18.

An electrically driven pump 21 for the refrigerant is fastened on the second heat exchanger 18 and has two connectors 22, 23, of which one 22 is provided for connection to one of the refrigerant lines 5, 6 and the other 23 opens out into the second heat exchanger 18. A further connector 24 for connection to one of the refrigerant lines 5, 6 is disposed on the top half-tray of the second heat exchanger 18. An electric supply cable 25 for the pump bears a plug 26. A non-illustrated bushing which complements the plug 26 and is intended for supplying power to the pump 21 is disposed on the inner wall of the freezer compartment 2.

A control circuit 30 is provided on the pump 21. It is configured in order to supply the pump 21 with power, once a user has pushed a switch, for a period of time that is selected to be sufficient for freezing water introduced into the ice container 16. Once the period of time has elapsed, the control circuit 3*o* switches off the pump 21. The ice in the ice container then begins to melt slowly, which is very much desirable since the pieces of ice formed in the individual depressions 17 of the ice container 16 are easier to remove if they have melted at the surface.

It may also be provided that, once the period of time has elapsed, the control circuit 30 supplies the pump 21 with power intermittently, the duration of the switch-on phases of the pump 21 during intermittent operation being selected such that it is also the case that melting of the ice over a long period of time is avoided.

The length of the edges of the essentially rectangular second heat exchanger 18 correspond essentially to the width and depth of the freezer compartment 2, with the result that the second heat exchanger 18 can easily be placed in position by resting on protrusions formed on the side walls of the freezer compartment or engaging in rails disposed on these walls.

As an alternative, it is also possible to rest the second heat exchanger 18 loosely on a shelf 27 that is disposed at a small distance of a few centimeters from the top of the freezer compartment 2. This variant is expedient, in particular, if a user can install the ice maker in the refrigerator, and remove it therefrom, since the shelf 27, when not bearing the second heat exchanger 18, can then be utilized as a support for freezer packs or the like.

A possible refrigerant for the icemaker is, in particular, an alcohol or alcohol mixture or an alcohol/water mixture.

As an alternative to the above-described exemplary embodiments, it is, of course, also possible for the pump 21 and, if appropriate, its control circuit 30 to be contained in the first subassembly.

Of course, it is also possible for the freezer compartment 2 to be disposed at the top of the refrigerator and for the normal refrigerating or chiller compartment 1 to be disposed therebeneath; in this case, there is installation space provided for the second heat exchanger at the base of the freezer compartment 2.

We claim:

1. An icemaker for a refrigerator, the icemaker comprising:

an ice container including a body;

a refrigerant circuit containing a refrigerant and a first heat exchanger, said refrigerant circuit being in direct thermal contact with said ice container body through said first heat exchanger, said refrigerant circuit being separate from a further refrigerant circuit of the refrigerator to which the icemaker can be fitted, said refrigerant circuit further having a second heat exchanger to be placed in a cooling zone of the refrigerator;

said first heat exchanger forming said ice container body; and said ice container body having a plurality of compartments for forming ice therein.

2. The icemaker according to claim 1, including a separate ice tray conforming to said ice container body and having a plurality of depressions fitting into respective ones of said compartments for forming ice in said ice tray.

3. A refrigerator, comprising:

a first cooling zone;

a second cooling zone which can be retained at different temperatures than said first cooling zone;

an icemaker;

said icemaker including an ice container disposed in said first cooling zone including a body;

a refrigerant circuit containing a refrigerant and a first heat exchanger, said refrigerant circuit being in direct thermal contact with said ice container body through said first heat exchanger, said refrigerant circuit being separate from a further refrigerant circuit of the refrigerator, said refrigerant circuit further having a second heat exchanger disposed in said second cooling zone;

said first heat exchanger forming said ice container body; and said ice container body having a plurality of compartments for forming ice therein.

4. The icemaker according to claim 3, including a separate ice tray conforming to said ice container body and having a plurality of depressions fitting into respective ones of said compartments for forming ice in said ice tray.

5. An icemaker for a refrigerator, the icemaker comprising:

an ice container;

a refrigerant circuit containing a refrigerant and a first heat exchanger, said refrigerant circuit being in thermal contact with said ice container through said first heat exchanger, said refrigerant circuit being separate from a further refrigerant circuit of the refrigerator to which the icemaker can be fitted, said refrigerant circuit further having a second heat exchanger to be placed in a cooling zone of the refrigerator;

a pump for circulating the refrigerant; and a timing device for controlling operation of said pump.

6. The icemaker according to claim 5, wherein said second heat exchanger is configured as a reservoir for the refrigerant.

7. The icemaker according to claim 5, wherein the refrigerant is liquid throughout said refrigerant circuit under normal operating conditions of the icemaker.

8. The icemaker according to claim 5, wherein said second heat exchanger transmits heat to said cooling zone during operation of the icemaker.

9. The refrigerator according to claim 5, wherein said second heat exchanger is coupled to said first heat exchanger through a partition wall formed between said separate cooling zones.

10. The icemaker according to claim 9, including said first heat exchanger cooling zone temperature is maintained substantially cooler than said second heat exchanger cooling zone.

11. A refrigerator, comprising:

a first cooling zone;

a second cooling zone which can be retained at different temperatures than said first cooling zone;

an icemaker;

said icemaker including an ice container disposed in said first cooling zone; a refrigerant circuit containing a refrigerant and a first heat exchanger, said refrigerant circuit being in thermal contact with said ice container through said first heat exchanger, said refrigerant circuit being separate from a further refrigerant circuit of the refrigerator, said refrigerant circuit further having a second heat exchanger disposed in said second cooling zone;

a pump for circulating the refrigerant;

a timing device for controlling an operation of said pump; and a plug-in connector for supplying power to said pump, said plug-in connector disposed on an inner wall of said second cooling zone.

12. The refrigerator according to claim 11, wherein said second heat exchanger is disposed at a top or a bottom of said second cooling zone.

13. The refrigerator according to claim 11, wherein said second heat exchanger extends substantially over an entire width and/or depth of said second cooling zone.

14. The refrigerator according to claim 11, wherein said icemaker can be installed and removed from the refrigerator.

15. The refrigerator according to claim 11, wherein said refrigerant circuit, between said first and second heat exchangers, has refrigerant lines formed, at least in part, by flexible hoses.

16. The refrigerator according to claim 12, wherein said first and second heat exchangers are located in separate cooling zones and said second heat exchanger is coupled to said first heat exchanger through a partition wall formed between said first and second cooling zones.

17. The icemaker according to claim 16, including said first heat exchanger cooling zone temperature is maintained substantially cooler than said second heat exchanger cooling zone.

* * * * *